United States Patent [19]

Aharon

[11] Patent Number: 5,060,554

[45] Date of Patent: Oct. 29, 1991

[54] OPTICAL SIGHTING SYSTEM FOR A GUN MOUNTED ON MOBILE PLATFORM

[75] Inventor: Oren Aharon, Haifa, Israel

[73] Assignee: The State of Israel Ministry of Defence, Rafael Armament Development Authority, Tel Aviv, Israel

[21] Appl. No.: 575,073

[22] Filed: Aug. 30, 1990

[30] Foreign Application Priority Data

Sep. 6, 1989 [IL] Israel ..... 91539

[51] Int. Cl.[5] ..... F41G 1/40

[52] U.S. Cl. ..... 89/41.19; 89/36.14; 359/402; 359/403

[58] Field of Search ..... 89/41.06, 41.19, 41.21, 89/41.22, 36.08, 36.14; 250/347; 356/488, 253, 254, 255; 350/540, 541, 542

[56] References Cited

U.S. PATENT DOCUMENTS 2,492,353 12/1949 Brackett ..... 356/254
3,918,813 11/1975 Rossiter ..... 356/153
4,318,330 3/1982 Hausenblas ..... 89/41.05

FOREIGN PATENT DOCUMENTS 1151954 7/1963 Fed. Rep. of Germany ..... 350/541
2926973 1/1981 Fed. Rep. of Germany ..... 350/542
1378852 12/1974 United Kingdom ..... 356/255

OTHER PUBLICATIONS

Walker, Periscope Optics and the High-Powered Laser, Optical Systems Engineering, vol. 193, 1979, pp. 116–120.

*Primary Examiner*—Deborah L. Kyle
*Assistant Examiner*—Stephen Johnson
*Attorney, Agent, or Firm*—Helfgott & Karas

[57] ABSTRACT

A sighting system for arming a gun mounted on a self-propelled platform. The system comprising a periscope with a collimator having a source of monochromatic light and a swivelling mirror, and in association therewith an auxiliary sighting system so devised that a reticle or spot is projected from the collimator simultaneously into the lines of sight of the gunner and the commander. The auxiliary sighting system comprises a first dichroic mirror or beam splitter facing the head mirror and a second dichroic mirror or beam splitter vertically removed from the first one so as to be located in the commander's field of vision; and means for transmitting light between these two dichroic mirrors or beam splitters.

9 Claims, 2 Drawing Sheets

OPTICAL SIGHTING SYSTEM FOR A GUN MOUNTED ON MOBILE PLATFORM

FIELD OF THE INVENTION

The present invention is in the field of gunnery and concerns more specifically the aiming of a gun mounted on a mobile, self-propelled platform. A typical example of a gun carrying, self-propelled mobile platform to which the present invention is applicable is a combat tank having a gun mounted on a revolving turret, operated by a gunner seated within the tank and commanded by a commander situated remote of the gunner. Other examples of mobile, self-propelled gun-carrying platforms to which the present invention is applicable are various types of armoured cars, marine vessels such as gunboats and many more.

BACKGROUND OF THE INVENTION AND PRIOR ART

In gunnery a gun has to be raised or lowered for range adjustment and turned left or right for azimuth adjustment, all for bringing the gun into the correct position for hitting an identified target, and these operations are referred to herein as "aiming".

In self-propelled, gun-carrying platforms of the kind with which the present invention is concerned, e.g. a combat tank, there exists the need for a swift and reliable communication between the gunner and the commander. In classical arrangements the commander who observes the scene and identifies targets from his own position, communicates vocally with the gunner either directly or through an intercom. In the course of aiming the gunner reports to the commander and/or the commander gives orders to the gunner, and at a suitable moment, the commander gives the fire command. In this classical method valuable time is lost by the bi-directional vocal communication between the gunner and commander. This method is therefore unsatisfactory, in particular with modern gun-carrying, self-propelled mobile platforms with electronic fire control; in such platforms the fire command must be given at a very precise point of time as otherwise the target may be missed.

It has therefore already been proposed to provide systems by which the commander and gunner both follow the aiming of the gun in synchronisation in order to obviate the need for the gunner to report to the commander and when the sighting is right, the commander either gives the order to the gunner or alternatively presses himself a firing actuator. Such an arrangement is disclosed for example in U.S. Pat. No. 4,318,330. In accordance therewith a top-mounted gun of a tank is aimed by means of a fire control system including an optical observation and aiming system controlled by the vehicle gunner after a target, which has been optically sighted by the vehicle commander by means of a stabilized panoramic optical device, has been taken over by the vehicle gunner in his own individually stabilized optical device. After sighting a target the vehicle commander initiates a control signal which causes the actual values of positions of his panoramic optical device to be transmitted to the stabilization control of the gunner's optical device as rated values resulting in the two optical devices being aligned. Thereafter, in response to control signals generated by the gunner, the weapon is aimed at the target as seen through the gunner's optical device, the image of the target as seen by a target television camera fixedly mounted on the weapon is switched to a television monitor in front of the gunner, and then the weapon is finely aimed at the target as seen on the monitor and is fired.

Such sophisticated system is cumbersome, expensive and sensitive to the rough conditions prevailing in operation.

It is the object of the present invention to provide simple yet reliable optical auxiliary means in association with the gunner sighting and range-finding equipment by which the commander can follow the sighting and range-finding operation in synchronization with the gunner.

SUMMARY OF THE INVENTION

In accordance with the invention there is provided a sighting system for use in aiming a gun that is mounted on a self-propelled mobile platform being of the kind that comprises a gunner's periscope-type sighting device having near its lower end an eyepiece and an associated mirror and near its upper end a viewing opening and an associated pivoting head mirror or prism; a collimator for projecting an optical reticle or spot on said head mirror or prism; and electronic fire control means for correlating the position of the gun to the position of said head mirror; characterized by said collimator having a source of essentially monochromatic light and by auxiliary sighting means for use by a commander situated on said platform remote of the gunner, which auxiliary sighting means comprise a first window/reflector facing said head mirror or prism, a second window/reflector vertically removed from said first dichroic mirror, which first and second window/reflector are transparent to ambient light and capable of reflecting the monochromatic light arriving from said collimator; and means for transmitting light between said first and second window/reflectors whereby said optical reticle or spot is projected into the commander's direct or optically transmitted line of sight.

The term "window/reflector" denotes either a beam splitter or a dichroic mirror. The expression "the commander's direct or optically transmitted line of sight" connotes an optically unaided line of sight or a line of sight transmitted to the commander by optical sighting means.

In accordance with one embodiment of the invention said means for transmitting light reflected by said first and second window/reflectors is a tube whose length may, if desired, be adjustable, e.g. by being composed of two or more telescoping tubes.

In accordance with another embodiment of the invention said means for transmitting light reflected by said first window/reflector to said second window/reflector is a bundle of optical fibres having light receiving and light emitting ends associated with suitable terminal optical transmitter means.

The invention is applicable to any self-propelled gun-carrying platform, typical examples being combat tanks, armoured vehicles, marine vessels such as gunboats and the like.

DESCRIPTION OF THE DRAWINGS

The invention will now be described, by way of example only, with reference to the annexed drawings in which.

DESCRIPTION OF SPECIFIC EMBODIMENTS

Figure 1:
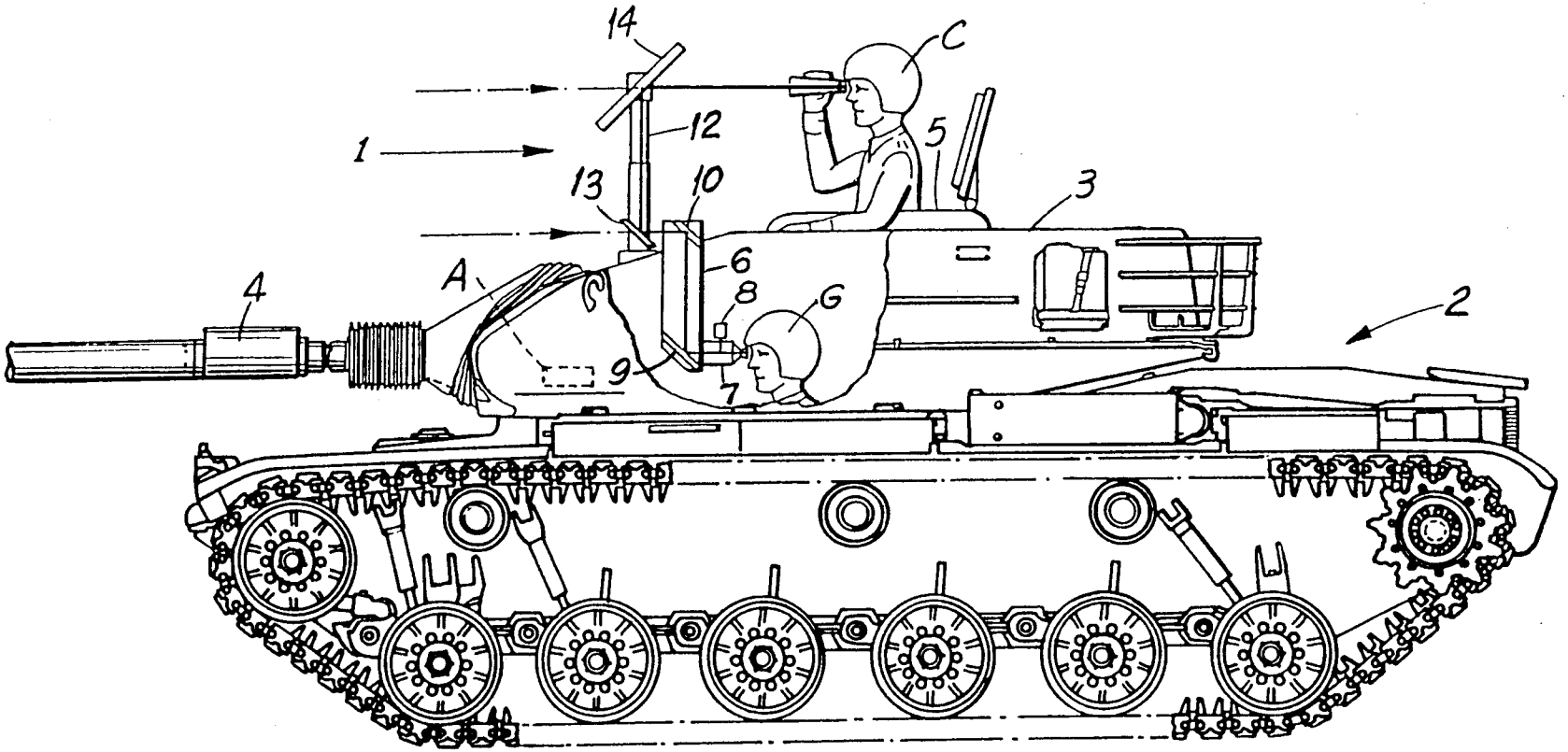
FIG. 1 is an elevation of a battle tank with a revolving turret, partly broken open, fitted with a first embodiment of a sighting system according to the invention.

In the embodiment shown in FIG. 1 a sighting system according to the invention 1 is mounted on a tank 2 having a revolving turret 3 on which is mounted a gun 4. A gunner G is shown within the turret and a commander C emerges partly through a manhole 5 thereof.

The sighting system 1 comprises a periscope 6 having near its lower end an eyepiece 7 fitted with a collimator 8 having a source of essentially monochromatic lighting, e.g. a laser diode, a light emitting diode (LED) or any other essentially monochromatic light source, in association with a dichroic mirror (not shown) which is transparent to ambient light and reflects the light generated by collimator 8 into the gunner's line of sight. Eyepiece 7 is further associated with a prism or mirror 9. Near its upper end periscope 6 comprises a pivoting head mirror 10.

Instead of being associated with eyepiece 7 the collimator 8 may be near any other suitable aperture in the lower end region of the periscope 6 which may be specially provided for the purpose.

Periscope 6 with the collimator 8 and pivoting head mirror 10 is of known design and is of a kind that is conventionally mounted in tanks.

The sighting system according to the invention further includes auxiliary sighting means comprising a tube 12 fitted with a lower, first window/reflector 13 facing the head mirror 10, and an upper, second window/reflector 14 vertically removed therefrom.

In operation the gunner G sights the target through periscope 6 and operates the range finder. The collimator 8 projects an optical reticle or spot on head mirror 10 which latter is caused to swivel by electronic fire control means A (schematically shown in the drawing) operated by the gunner which simultaneously and in a correlated manner also raises or lowers the gun and turns it left or right, all as may be required for aiming and all as known per se. When the sighted target coincides with the optical reticle or spot the gun is locked on the target and is ready for firing.

The optical reticle or spot that is reflected by mirror 9 onto head mirror 10, is reflected from there via the first window/reflector 13 and tube 12 to the second window/reflector 14 and is projected into the line of sight of the commander C as shown by way of bold lines in FIG. 1 Consequently, with the coincidence of the target and the optical reticle on the head mirror 10 a similar coincidence occurs on the window/reflector 14 so that the commander C and the gunner G perceive simultaneously the fact that the gun is in a position in which it is locked on the target. In such locking position of the gun the commander may either instruct the gunner to fire or else do it himself by means of a suitable actuator.

Figure 2:
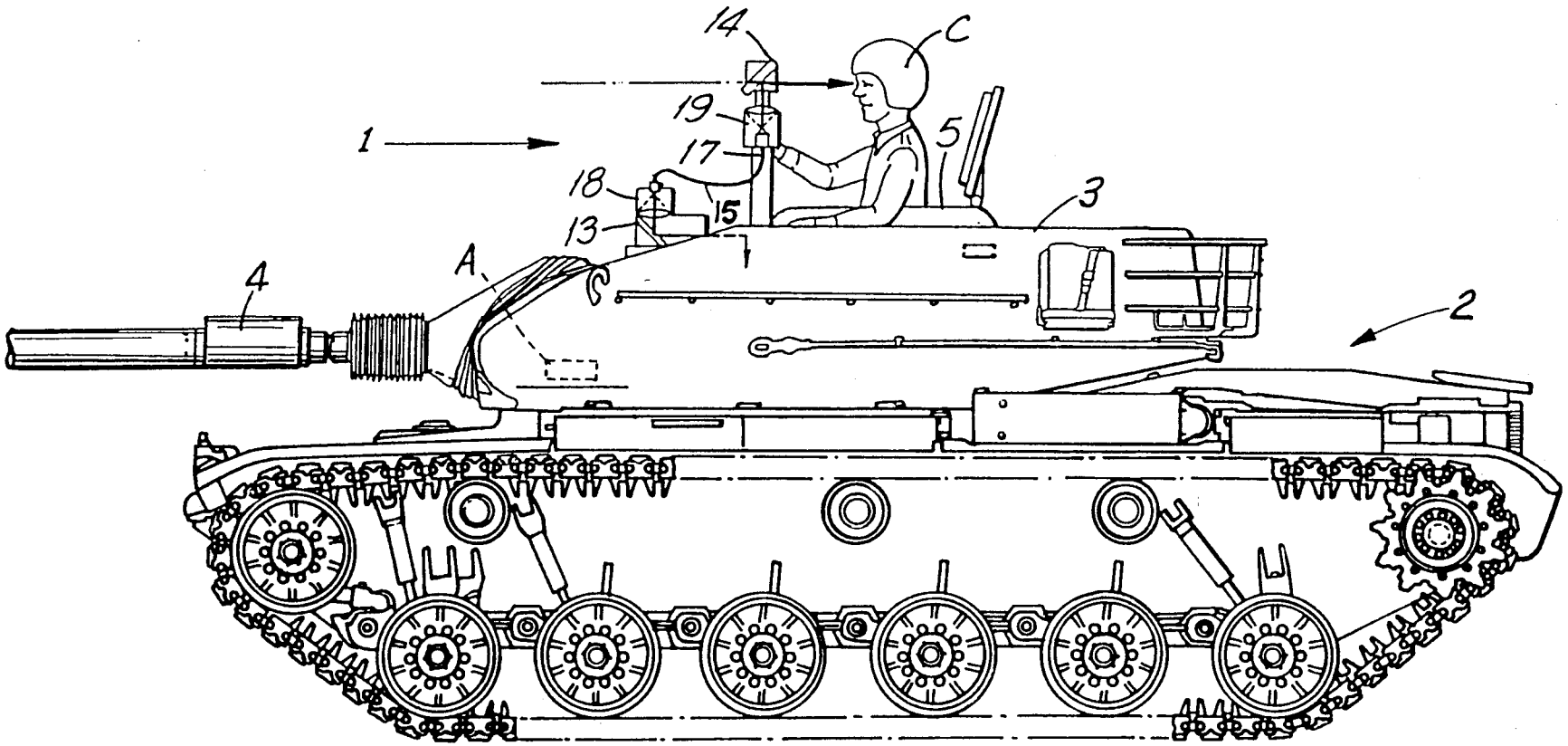
FIG. 2 is an elevation of a battle tank with a revolving turret, partly broken open, fitted with a second embodiment of a sighting system according to the invention.

The embodiment of FIG. 2 is essentially similar to that of FIG. 1 and similar parts are designated by the same numerals. In this embodiment the tube 12 of the auxiliary sighting system shown in FIG. 1 is replaced by a bundle of optical fibres 15 whose receiving and emitting ends 16 and 17 are fitted with optical transmitting systems 18 and 19, respectively. The operation is the same as in the embodiment of FIG. 1.

I claim:

1. In a sighting system for use in aiming a gun that is mounted on a self-propelled mobile platform being of the kind that comprises a gunner's periscope-type sighting device having near a lower end thereof an eyepiece and an associated mirror and near an upper end thereof a viewing opening and one of an associated pivoting head mirror and prism; a collimator for projecting an optical reticle or spot on said one of associated head mirror and prism; and electronic fire control means for correlating the position of the gun to the position of said head mirror, the improvement comprising said collimator having a source of essentially monochromatic light and said system including auxiliary sighting means for use by a commander situated on said platform remote of the gunner, said auxiliary sighting means including first and second window reflectors of which the first window/reflector faces said one of associated head mirror and prism and the second window/reflector is vertically spaced from said first window/reflector, said first and second window/reflectors being transparent to ambient light and capable of reflecting the monochromatic light arriving from said collimator; and means for transmitting light between said first and second window/reflectors whereby said optical reticle or spot is projected into the commander's line of sight.

2. A sighting system according to claim 1, wherein said means for transmitting light between said first and said second window/reflectors is a tube.

3. A sighting system according to claim 2, wherein the length of said tube is adjustable.

4. A sighting system according to claim 1, wherein said means for transmitting light between said first and second window/reflectors is a bundle of optical fibres having light receiving and light emitting ends associated with suitable terminal optical transmitter means.

5. A self-propelled gun carrying platform fitted with a sighting system according to claim 1.

6. A self-propelled gun carrying platform fitted with a sighting system according to claim 2.

7. A self-propelled gun carrying platform fitted with a sighting system according to claim 4.

8. A sighting system according to claim 1, wherein said transmitting means is constructed so that said optical reticle or spot is projected directly into the commander's line of sight.

9. A sighting system according to claim 1, wherein said transmitting means is constructed so that said optical reticle or spot is optically transmitted into the commander's line of sight.

* * * * *